United States Patent [19]

Almestad

[11] Patent Number: 4,704,766

[45] Date of Patent: Nov. 10, 1987

[54] CONCEALED HINGE

[76] Inventor: Henry C. Almestad, 1261 Contra Costa Dr., El Cerrito, Calif. 94530

[21] Appl. No.: 376,947

[22] Filed: May 11, 1982

[51] Int. Cl.[4] ..... E05D 7/04

[52] U.S. Cl. ..... 16/236; 16/392; 49/388; 312/111; 312/258

[58] Field of Search ..... 49/388; 312/258, 282, 312/111; 16/389, 390, 391, 392, 236, 386

[56] References Cited

U.S. PATENT DOCUMENTS

| | | | |
|---|---|---|---|
| 384,808 | 6/1888 | Wiederer | 16/389 X |
| 453,803 | 6/1891 | Faulhaber et al. | 16/314 |
| 963,352 | 7/1910 | Blackman | 312/258 X |
| 2,385,169 | 9/1945 | Stone | 16/390 |
| 2,661,495 | 12/1953 | Kalleberg | 16/315 |
| 3,006,039 | 8/1961 | Brydolf | 16/389 X |
| 3,131,422 | 5/1964 | Agius | 16/392 |
| 3,197,804 | 8/1965 | Ennis | 16/383 |
| 3,299,573 | 1/1967 | Gustafson | 16/390 |
| 3,323,163 | 6/1967 | Goodnow | 16/249 |
| 3,506,326 | 4/1970 | Tantillo | 16/389 |
| 3,604,154 | 9/1971 | Curran | 49/501 |
| 3,662,493 | 5/1972 | Foltz | 49/388 |
| 4,200,956 | 5/1980 | Ullman, Jr. | 16/235 |

*Primary Examiner*—Mark Rosenbaum

*Attorney, Agent, or Firm*—James R. Cypher

[57] ABSTRACT

A hinge for mounting a substantially planar faced door in a cabinet flush with the cabinet frame. The hinges are substantially invisible when viewed from the front and sides of the cabinet. The top hinge has a door plate member connected to the top edge of the door and a base plate member connected to the bottom face of the top base of the cabinet. The two hinge members are connected by a pivot pin. The hinge assembly is located adjacent the front face of the door and adjacent a side edge of the door. A similar hinge is attached to the bottom edge of the door.

8 Claims, 17 Drawing Figures

CONCEALED HINGE

BACKGROUND OF THE INVENTION

Present hinges for wood cabinet doors which are designed to be invisible when the door is closed are expensive and difficult to install. An example of such an invisible hinge is the Soss hinge which has one side imbedded in the vertical face of the door frame and the other side embedded in the vertical edge of the door.

Faulhaber, U.S. Pat. No. 453,803, June 9, 1891 discloses a self closing door which requires the pivot pin to be imbedded in the frame.

Stone, U.S. Pat. No. 2,385,169, Sept. 8, 1945, discloses a hinge for a metal cabinet in which the hinge leaves protrude into the room and are far from invisible.

Kalleberg, U.S. Pat. No. 2,661,495, Dec. 8, 1953 is a double acting gravity hinge which exposes a considerable portion of the hinge.

Ennis, U.S. Pat. No. 3,197,804, Aug. 3, 1965 discloes a hinge in which the pivot pin and portions of the hinge leaves protrude in front of the room side face of the door.

Gustafson, U.S. Pat. No. 3,299,573, Jan. 24, 1967 is a hinge which, like Ennis, supra exposes the hinge pin and a portion of the hinge leaves on the room side of the door.

Goodnow, U.S. Pat. No. 3,323,163, June 6, 1967 also exposes the hinge pin and a portion of the leaves of the hinge on the room side of the door.

Tantillo, U.S. Pat. No. 3,506,326, Apr. 14, 1970, is a specialized hinge for mirrors but the hinge pin and a portion of the hinge mechanism are exposed.

Curran, U.S. Pat. No. 3,604,154, Sept. 14, 1971 attempts to hide his hinges for a wood cabinet but they are all too visible as illustrated in his drawings.

Foltz, U.S. Pat. No. 3,662,493, May 16, 1972 discloses a double acting pivot for doors. The hinge mechanism is exposed even though portions of the hinge extend into the edge of the door.

Ullman, U.S. Pat. No. 4,200,956, May 6, 1980 discloses hardware for a glass door. The hardware for holding the glass is entirely exposed.

SUMMARY OF THE INVENTION

This application discloses a hinge for a closure member such as a cabinet door which is completely invisible from the room side of the door when it is in the closed position.

The hinge is inexpensive to manufacture, using simple manufacturing steps and inexpensive elements.

The hinge is easy to install in a very short period of time.

Since the hinge is completely invisible from the room side, only one style of hinge need be manufactured and stocked at retail and only one or two colors are necessary. As a result, further economies may be effected in that the manufacturer need only have one set of dies and both the manufacturer and retailer need only carry a limited inventory.

Even though the hinge may be constructed from relatively light materials, the manner of placement not only permits a stronger pivotal connection, permitting the hanging of heavy doors but the cabinet itself is strengthened.

The hinge is easy to adjust to correct any misalignment which may occur from long usage or abuse.

The door itself may be easily removed for painting or repair.

The hinge is so easy to install that it is ideal for the average homeowner as well as the professional cabinet maker.

The hinge may be made in a variety of sizes to accomodate different size doors without any basic change in the hinge other than weight of material.

The hinge is ideal for use in hanging mirror faced doors.

The hinge is constructed so that the door swings easily and noiselessly.

The hinge permits a close fit between the door and frame to reduce unsightly gaps.

The construction reduces friction for smooth, free hinge operation.

The hinge construction places all of the weight on the pivot point thereby relieving the screws of almost all of the strain imposed by the operation of the door.

The hinge may be installed without the use of templates.

In a modified form of the hinge, upper and lower doors may be hinged on the same hinge member.

In still another modified form, pairs of upper and lower doors may be mounted on the same hinge member.

DESCRIPTION OF THE PREFERRED EMBODIMENTS OF THE INVENTION

Figure 2:
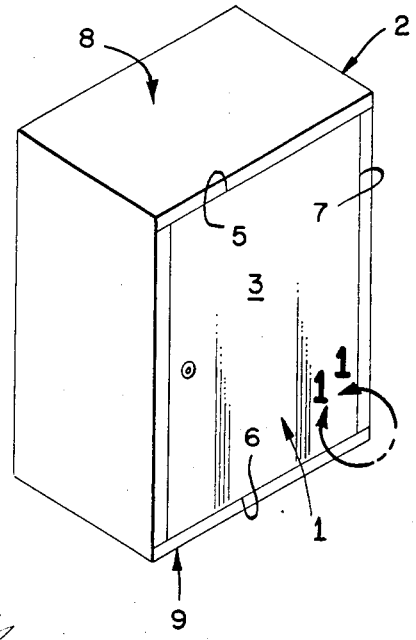
FIG. 2 is a perspective view of a cabinet illustrated on a reduced scale with the hinge of the present invention installed. Note that the hinge is invisible from the room side of the door.

Referring to FIGS. 1–4 and 6, the hinges are designed to be invisible when viewed from the room side of the door and are hereafter referred to as "invisible hinges". The hinges are attached to the doors in pairs and are reverse images of each other. For simplification, only one hinge of each set is described. The hinges are for mounting a door 1 as in a cabinet 2. The door has a front face 3, a rear face 4, top and bottom edge faces 5 and 6 and end face 7 mounted in a frame defining an opening having generally parallel top and bottom bases 8 and 9, and a perpendicular jamb frame member 10 presenting a side face 11 generally parallel to the door end face 7. Each of the hinges includes an elongated door plate member 12 having a front edge 13, a rear edge 14, a pivot end edge 15 and a distal end edge 16. Openings 17 are formed in the door plate 12 and are adapted for receipt of screw fasteners to attach the door plate to the respective door bottom 6 and top face 5.

A base plate member 19 formed with fastener openings 20 adapted for receipt of screw fasteners therethrough for engagement with the respective top and bottom frame bases 8 and 9 forms the second part of the invisible hinge. Pivot means such as a pin 21 connect the door plate member 12 at a location adjacent the front edge 13 and pivot edge 15 to the base plate member 19 at a location overlying or underlying the door 1. In referring to the pin 21 as adjacent the front edge 13, it is understood that the pivot joint is closer to the front edge than it is to the center line of the door plate member. The pivot pin 21 is located with respect to the door plate and the base plate at a point sufficient distance from the side face 11 of the perpendicular jamb frame member 10 and front face 3 of the door so that the arc scribed by the front pivot corner 22 of the door adjacent the perpendicular jamb frame member does not intersect the side face 11 of the perpendicular jamb frame member 10. Preferably pivot pin 21 is located on a projection 25.

For ease of installing the hinge members, the base plate members 19 are each formed with a front edge 23 in which a portion 24 is parallel and coincident with a portion of the rear edge 14 of the door plate member 12. In the form of the invention shown in FIGS. 1, 3 and 4, the invisible hinges include a side angle member 26 joined at right angles to the base plate member 19 and formed with fastener openings 27 adapted for receipt of fasteners 28 for connection to frame side member 29.

For ease in installing the door plate on the door, the rear edge 14 of the door plate 12 is dimensioned for location parallel and coincident with the rear face 4 of door 1.

As illustrated in FIGS. 1, 3, 4 and 6, the door plate 12 may be formed with a rear side member 31 connected to the rear edge of the door plate and is formed with fastener openings 32 adapted for connection to the rear face 4 of the door 1.

Figure 3:
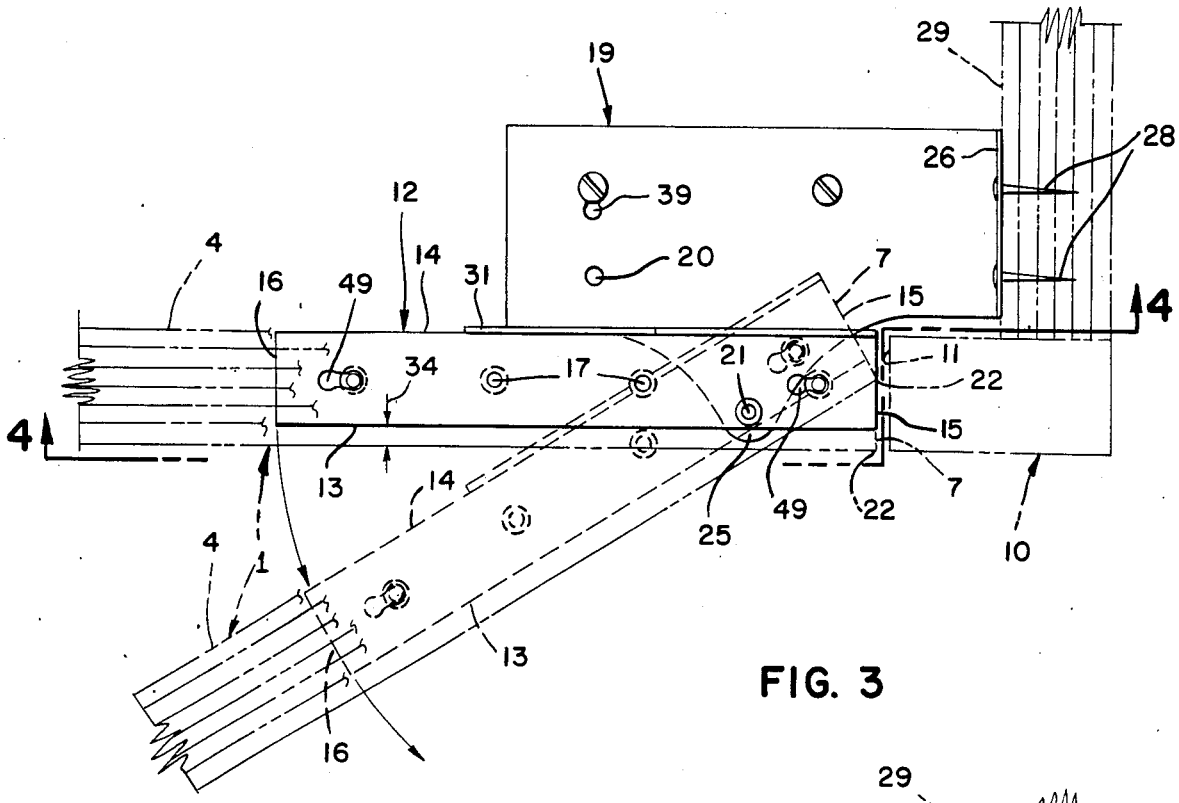
FIG. 3 is a plan view of the bottom hinge shown in FIG. 1 looking down upon the hinge. A portion of the cabinet and the partially opened door is shown.
Figure 4:
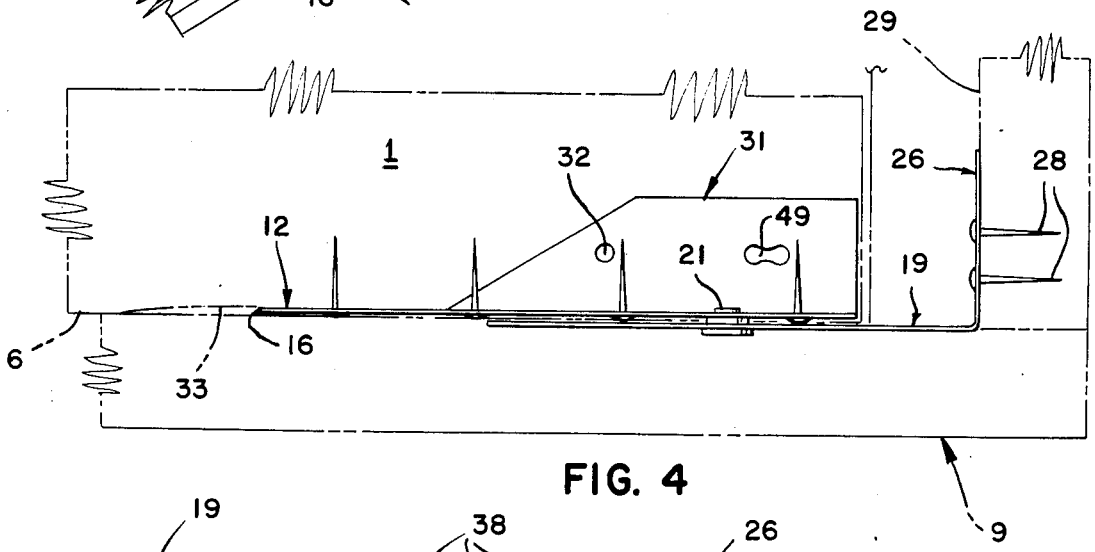
FIG. 4 is a side view of the hinge taken along line 4—4 of FIG. 3.

As best illustrated in FIG. 4 the top and bottom edge faces such as bottom edge face 6 of the door 1 is preferably formed with a routed portion 33 having a depth substantially the same as the thickness of the door plate member 12 leaving portion of the front face of the door indicated by facing arrows 34 in FIG. 3, extending above and below the door plate members. The door plate member 12, having a thickness substantially equal to the routed portion 33 is dimensioned for receipt within the routed portion of the top and bottom edges of the door.

Figure 5:
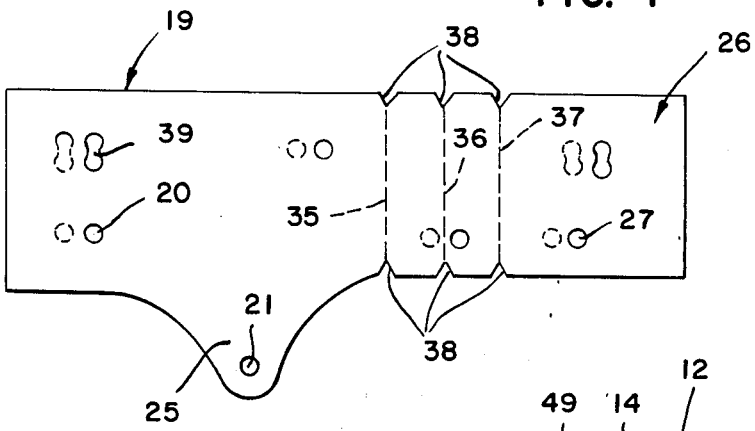
FIG. 5 is a plan view of a modified form of the hinge blank prior to bending showing the base plate portion.
Figure 6:
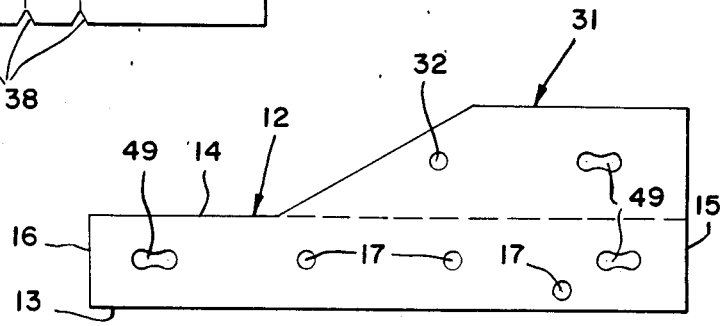
FIG. 6 is a plan view of the portion of the hinge which is attached to the door and shown in the unbent condition.

An alternate form of the base plate member is illustrated in FIG. 5. The means for permitting bending along two or more lines 35, 36 and 37 consists of either cutouts 38 or score lines along lines 35–37.

Adjustment of the location of the door plate members is effected by elongating at least one of the fastener openings 39 in the base plate member 19 in a direction at right angles to the door. Adjustment of the location of the door in respect to the door plate members is effected by forming slotted openings 49 in the door plate member.

Figure 7:
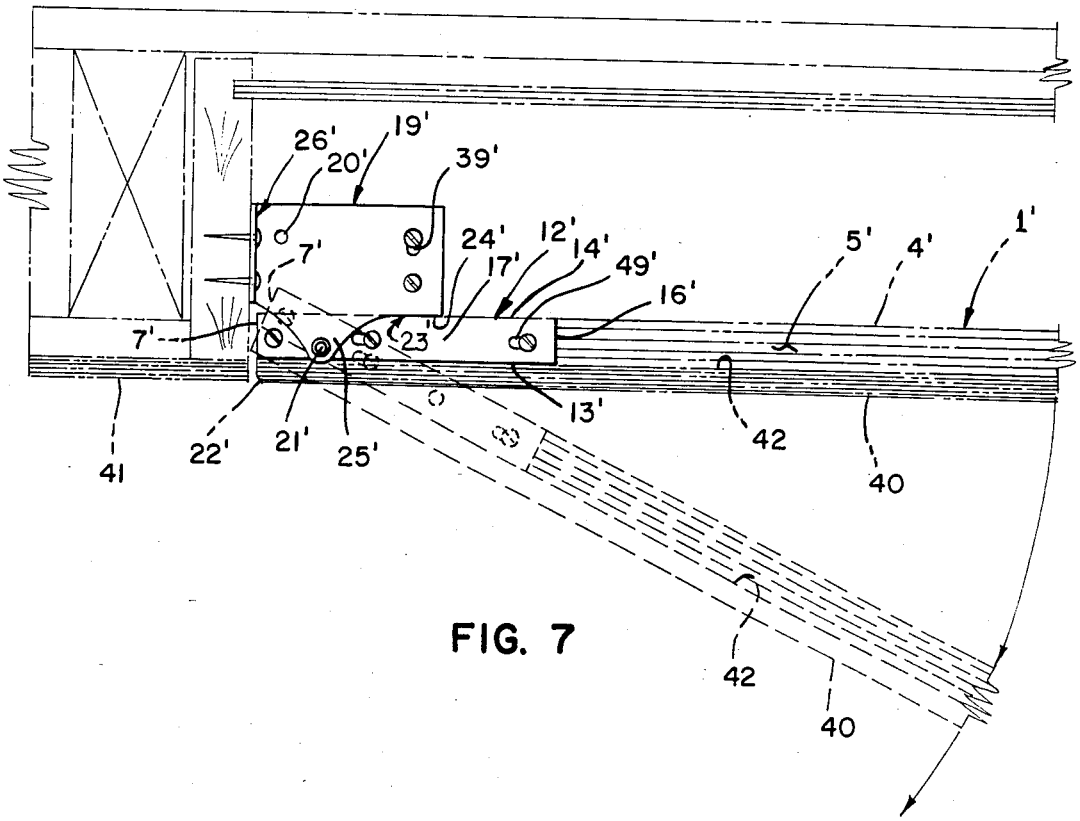
FIG. 7 is a top plan view of the top hinge as used in a cabinet having a plate mirror attached to the door. A portion of the side and back of the cabinet is shown. A portion of the door is shown in solid line in the closed position and in the partially opened position in broken line.

FIG. 7 illustrates an alternate form of the invention in which a mirror 40 is attached to the door 1'. For simplification, like parts are indicated by prime numbers. This form of the invention may be used in cabinet work and is particularly applicable where there is another mirror 41 mounted in side by side parallel relationship. Only a very small gap occurs between the mirrors and the hinges are invisible when the door is closed. The door plate 12' is dimensioned so that the front edge 13' is generally parallel to rear face 42 of the mirror.

Figure 8:
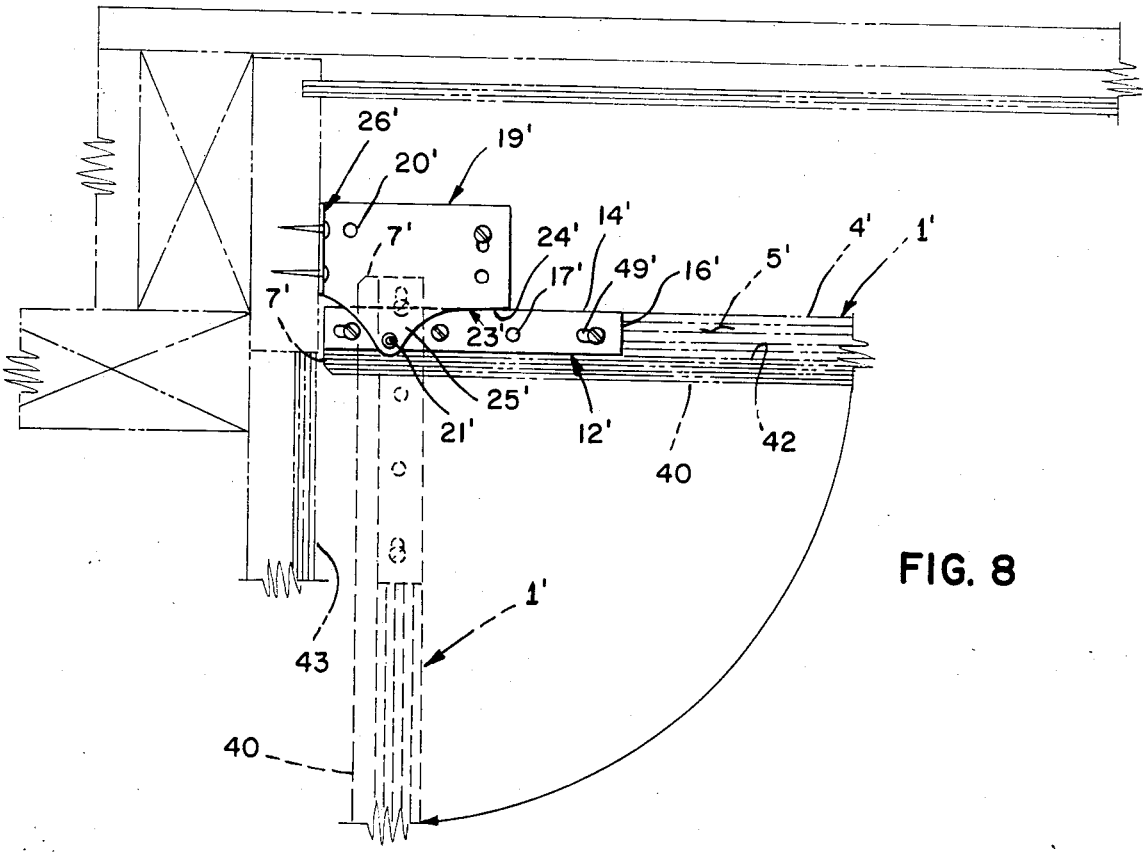
FIG. 8 is a top plan view of the top hinge of the present invention shown installed in conjunction with a corner mirror. A portion of the cabinet is included with a portion of the door in solid line in the closed position and in the open position in broken line.

FIG. 8 illustrates the installation of the hinges shown in FIG. 7 in which a corner mirror is shown. No change in the hinges is required. Like parts are numbered with primmed numbers.

Figure 1:
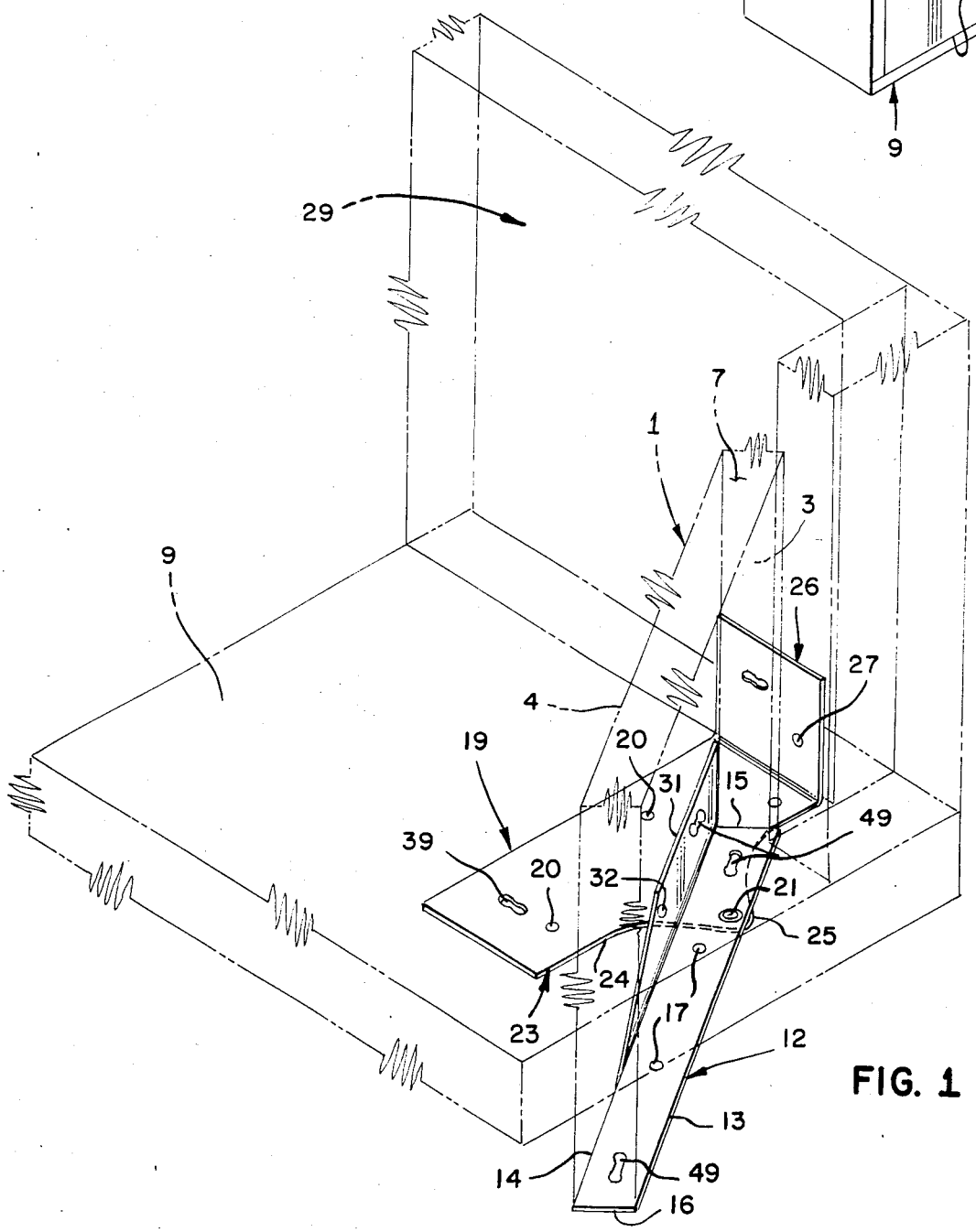
FIG. 1 is a perspective view of a bottom hinge constructed in accordance with the present invention with a portion of the side and bottom of a cabinet and a portion of a door in a partially opened position taken generally within lines 1—1 of FIG. 2.
Figure 9:
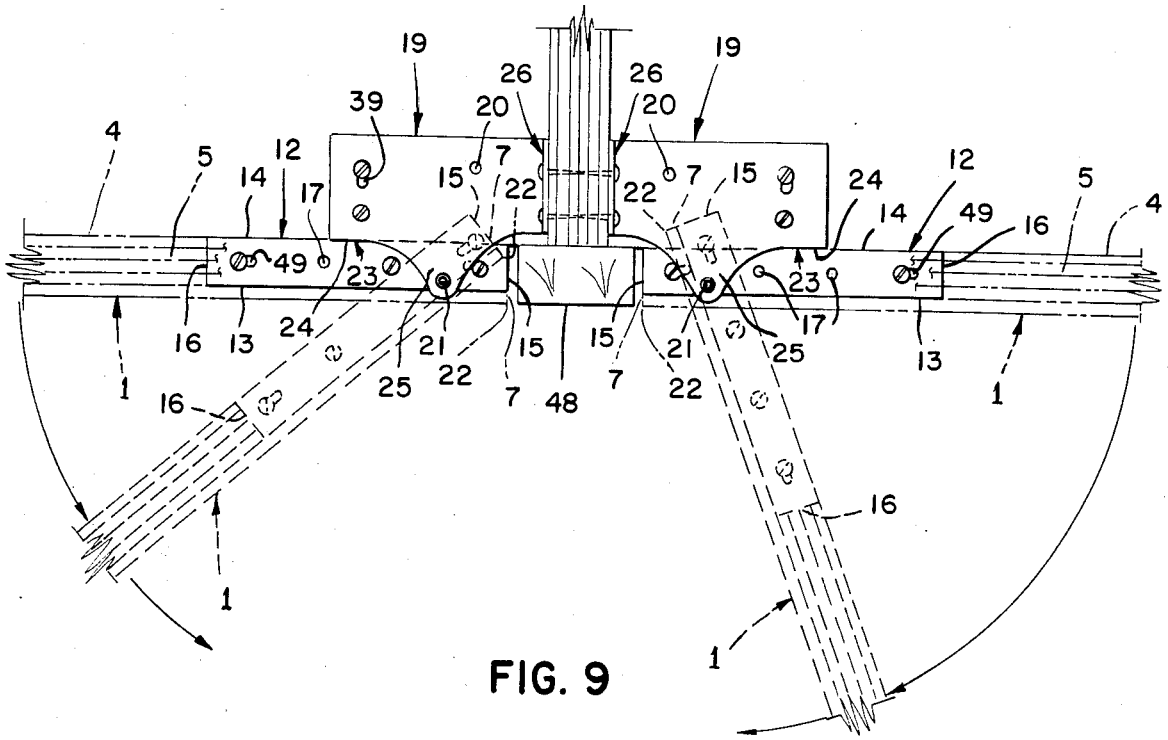
FIG. 9 is a top plan view of two hinges of the present invention installed with a mullion therebetween. Portions of the two doors are shown in solid line in the closed position and in broken line in the partially open position.

FIG. 9 illustrates the use of hinges identical to FIGS. 1 and 3 except that a mullion 48 is inserted between adjacent doors 1. For purposes of illustration the top hinges are shown. Like parts are shown by like numbers even though the hinges at the top are the reverse of the hinges directly below them.

Figure 11:
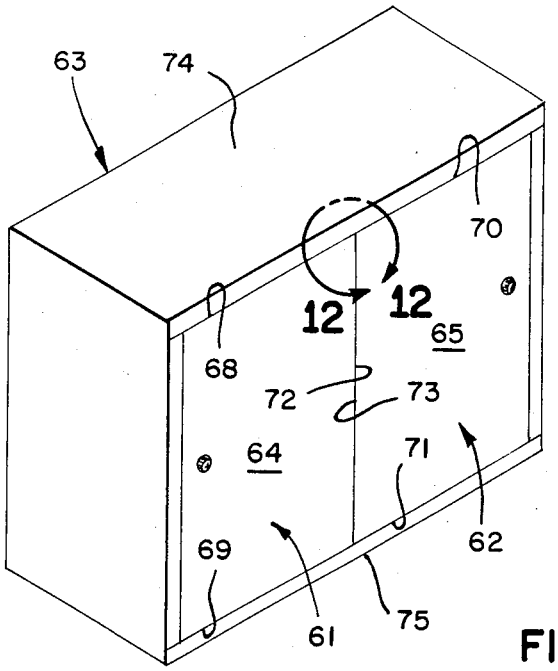
FIG. 11 is a perspective view of a two door cabinet with the invisible hinges installed.
Figure 12:
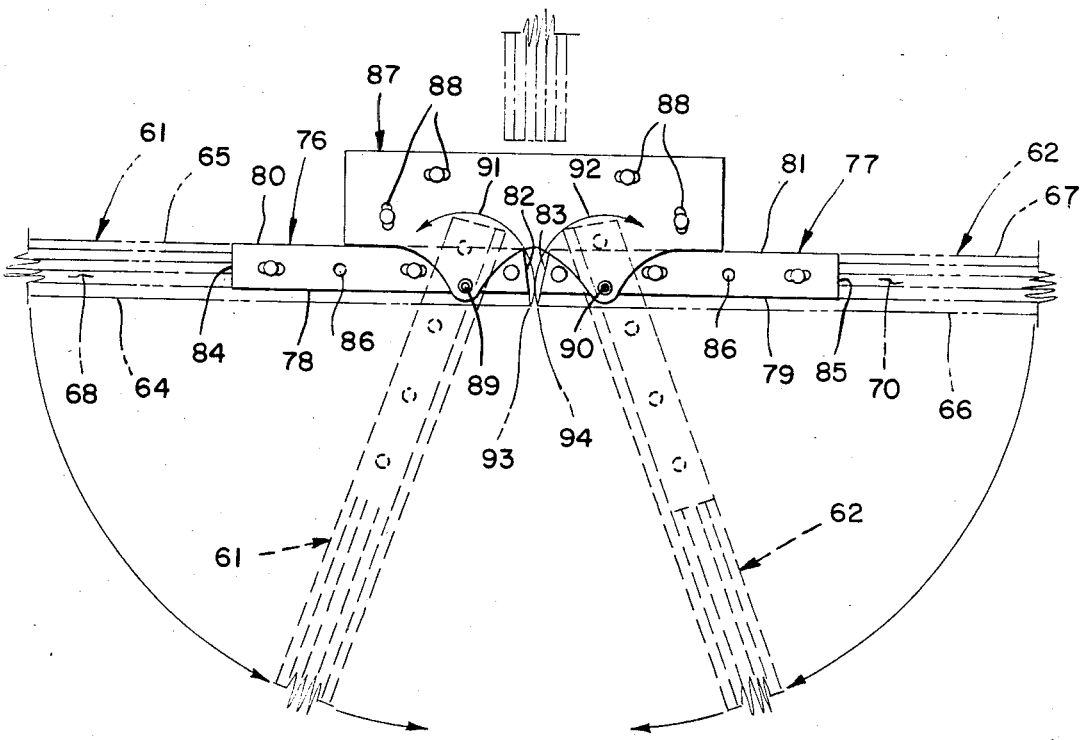
FIG. 12 is top plan view of another modified hinge showing the top hinges which are installed in the cabinet of FIG. 11 in the vicinity of line 12—12. A portion of the two doors are shown in solid line in the closed position and in broken line in the partially open position.

FIGS. 11 and 12 illustrate still another form of the invisible hinges. A pair of invisible hinges are mounted on a pair of doors 61 and 62 mounted in edge to edge relation for rotation in opposite directions in a cabinet 63. The doors have front and rear faces 64–67, top and bottom edge faces 68–71, and side faces 72 and 73, mounted in a frame defining an opening having generally parallel top and bottom bases 74 and 75. The top and bottom hinges each comprise the same elements except they are the reverse image. For purposes of brevity only the top hinge is illustrated in FIG. 12 and described. Top and bottom pairs of door plate members 76 and 77 have front edges 78 and 79, rear edges 80 and 81, pivot end edges 82 and 83, distal end edges 84 and 85 and are formed with fastener openings 86 adapted for connection to the respective door bottom and top faces.

A base plate member 87 is formed with fastener openings 88 adapted for engagement with the respective top and bottom frame bases 74 and 75. Pairs of top and bottom pivot means such as pins 89 and 90, are connected to the door plate members at a location adjacent the front edges 78 and 79 and the pivot end edges 82 and 83 and are connected to the base plate members at a location overlying and underlying the doors. The pivot means are located with respect to the door plate and the base plates at points sufficient distance from the adjoining planar sides 72 and 73 of the doors so that the arc as indicated by arrows 91 and 92 scribed by the front pivot corners 93 and 94 of each of the doors 61 and 62 in edge to edge relationship do not intersect one another.

Figure 10:
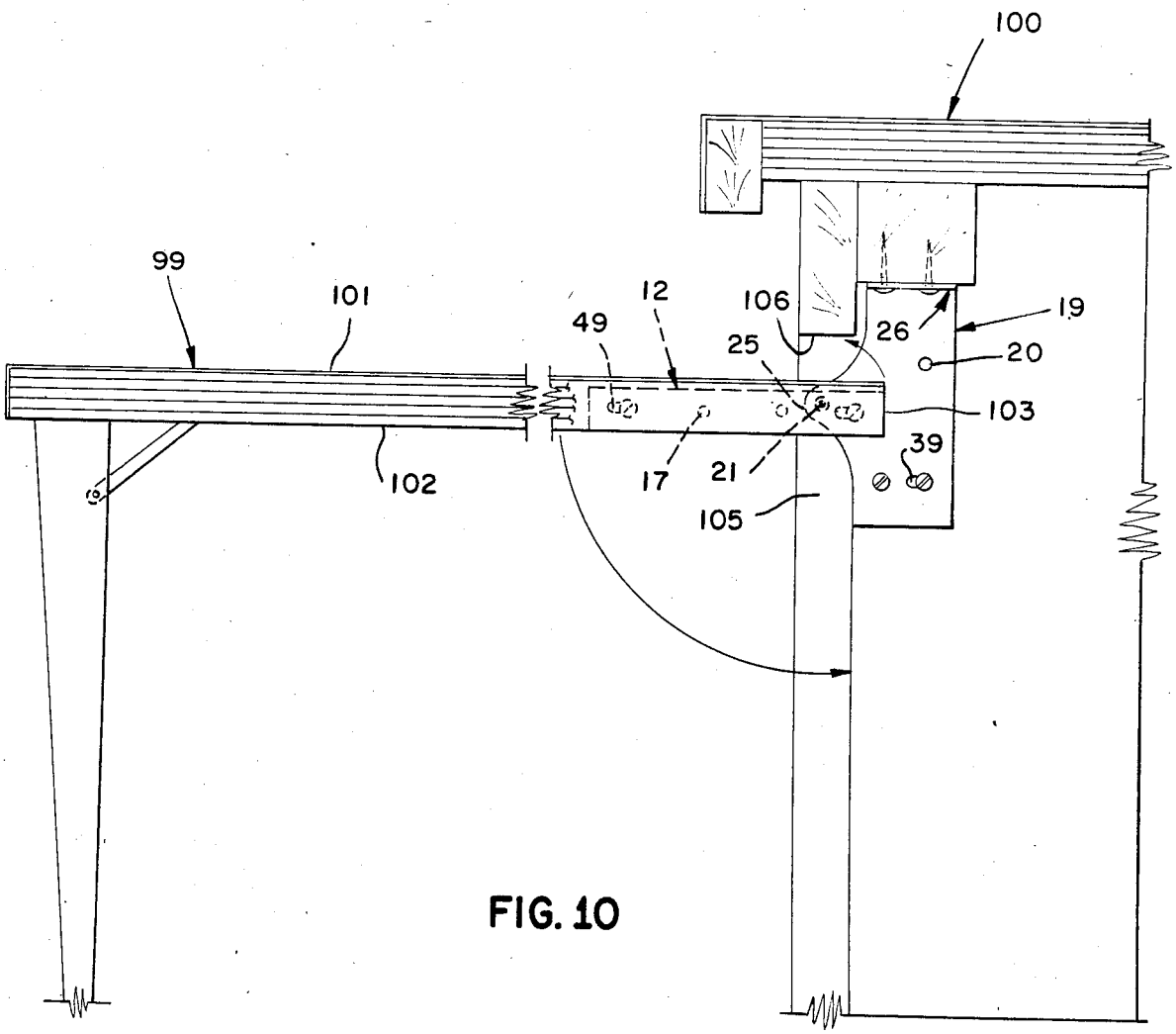
FIG. 10 is a side view of a folding side table showing a modified form of the hinge attached to the underside and side of the table and to the side table.

FIG. 10 illustrates another modified form of the invisible hinges in which a folding side table 99 is attached to a main table or desk 100. This side table, for example could be used as a typing stand or folded out of the way if not to be used to support a typewriter, computer or other equipment. The side table has a generally planar top 101, a generally planar bottom face 102, generally planar right and left side faces and a generally planar end face 103 mounted on a table frame defining an opening having generally planar right and left sides (left side 105 only is shown) and a beam member presenting a generally planar bottom face 106 generally parallel to the side table end face 103. The hinge is identical to the hinge illustrated and described in FIG. 9 except that the rear side member 31 is omitted. Like numbers refer to identical parts.

Installation of the hinges for the cabinet illustrated in FIGS. 1–4 and 6 is as follows.

1. Mark the top and bottom bases 8 and 9 on the inside of the cabinet 2 with a line that represents the rear face 4 of the door 1 with a combination square or suitable marking gauge.

2. Place the hinge in place so that the side member 26 of the base plate member 19 is up against the side member 29 of the cabinet and front edge 23 of base member 19 lines up with the rear face 4 of the door 1.

3. With an awl mark both slotted adjusting screw holes 39 only deep enough to hold the screws. Make a depression in the wood for the pivot rivet head 21 clearance, and then remove the hinge.

4. Follow the same procedure in locating the upper hinge for the cabinet door.

5. Mortise in and install the door plate member 12 for both the top and bottom edge of the door so that the rear edge 14 is flush with the rear face 4 of the door and pivot end edge 15 is flush with side face 7 of the door. Mark adjusting screw holes only with an awl and install screws. A depression should be made in the door for pivot rivet head 21 so that the door plate 12 will lay perfectly flat and flush with the edge of the door.

6. Place the door 1 with hinges installed into position in the cabinet and tighten the adjusting screws on the base plate meaber 19.

7. Check the door for correct position. If correction is necessary loosen adjusting screws, adjust door and re-tighten screws. When the door is in the correct position install the balance of the screws and tighten.

To install the base plate member 19' illustrated in FIG. 5 it is necessary to determine the distance between the side member 29 and jamb side face 11 and then bend along the required bend line 35, 36, or 37. The balance of the installation is the same as described above.

Installation of the hinges with the mirrored doors illustrated in FIGS. 7 and 8 is basically the same as described previously except that it is desirable that the front edge 13' be flush with the backside of the mirrors 40.

Installation of the hinges of FIG. 9 is no different than those previously described. The top hinges ae shown and a mullion 48 separates the doors.

Installation of the hinges in FIG. 10 is basically the same as for the doors which pivot about a vertical axis. In the table shown in FIG. 10, the table 99 rotates about a horizontal axis.

In FIGS. 11 and 12 the two hinges of FIG. 9 are merged and the center mullion 48 is removed. Adjustment of the doors 61 and 62 on the door plate members 76 and 77 is critical so that the edges of the doors do not intersect.

Figures 13, 14:
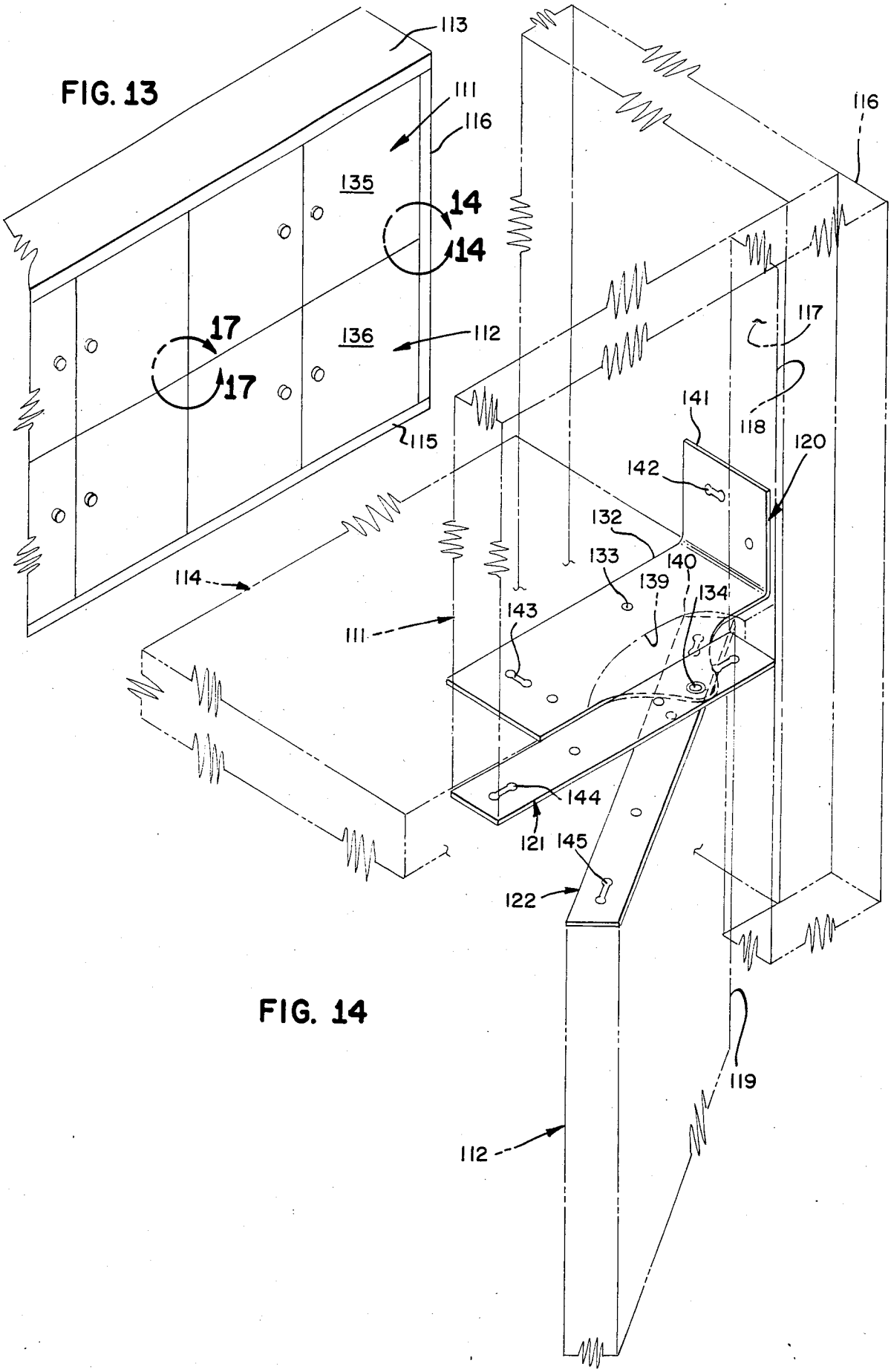
FIG. 13 is a perspective view of a portion of a cabinet having upper and lower doors mounted on a modified concealed hinge.
FIG. 14 is an enlarged perspective view of a portion of the cabinet shown in FIG. 13 and taken generally in the vicinity of lines 14—14.

FIG. 13 illustrates still another form of cabinet in which still another modified form of the invention is used.

Referring to FIGS. 13, 14, 15 and 16, upper and lower end doors 111 and 112 are mounted on top base 113, intermediate base 114, bottom base 115 and generally perpendicular jamb frame member 116 which presents an end face 117 generally parallel to the door end faces 118 and 119. The upper edge of door 111 and lower edge of door 112 are hinged by hinge members previously described and illustrated in FIG. 1–4. Only the intermediate door hinges which connect the lower edge of upper door 111 and the upper edge of door 112 are here described.

The intermediate hinge 120 is nearly identical in principle to the previously described hinges and consists of a pair of intermediate elongated door plate members 121 and 122, each having a front edge 123 and 124, a rear edge 125 and 126, a pivot end edge 127 and 128, and a distal end edge 129 and 130. Fastener openings 131 are formed in each door plate member. An intermediate base plate member 132 is formed with fastener openings 133 which are adapted for engagement with the intermediate base member 114 by screw fasteners. The intermediate pivot means such as pin 134 is connected to both intermediate elongated door plate members 121 and 122 at a location adjacent the front edge and pivot end edges and is connected to the intermediate base plate member at a location overlying the lower door and underlying the upper door. The pivot means is further located with respect to the respective intermediate door plates and intermediate base plate member at a point sufficient distance from the side face 117 of the perpendicular jamb frame member and from the front faces 135 and 136 of the upper and lower doors so that the arc scribed by the pivot corners 137 and 138 do not intersect the end face 117 of the perpendicular member.

The intermediate base member 114 is formed with a cut out 139 which is only slightly larger and describes the same arc as the inside corner 140 of the lower door. The intermediate base member may also be formed with an upturned flange 141 and formed with openings such as elongated openings 142 for receipt of fasteners therethrough which are attachable to the jamb frame member 116.

Adjustment openings 143 may be formed in the intermediate base plate member and adjustment openings 144 and 145 may be made in the door plate members.

Figure 15:
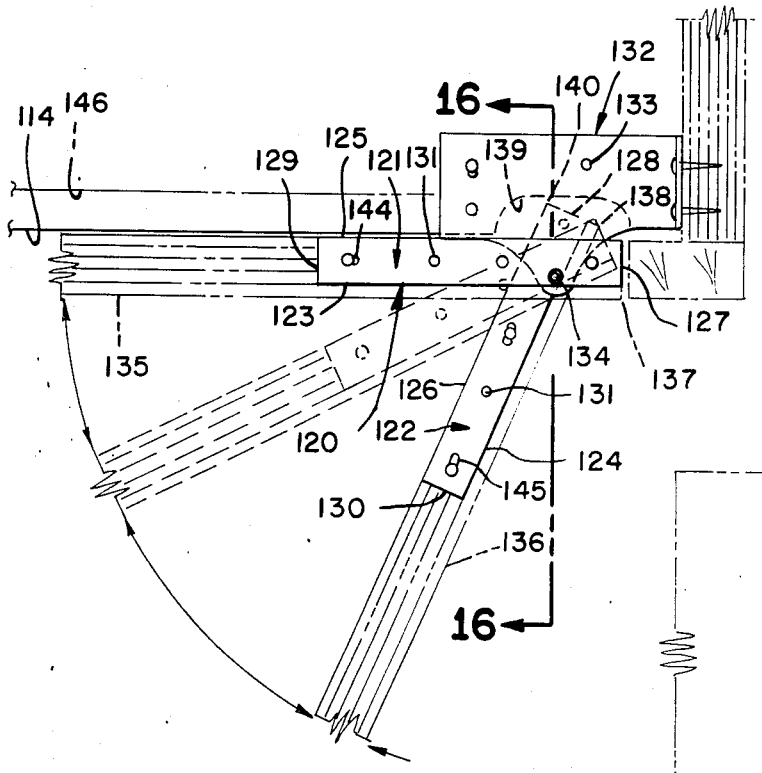
FIG. 15 is a top plan view of the hinge shown in FIG. 14 with portions in cross section and with the doors in phantom line. The hinge and portion of the door in dotted line indicates the intermediate position of either the upper or lower door.
Figure 16:
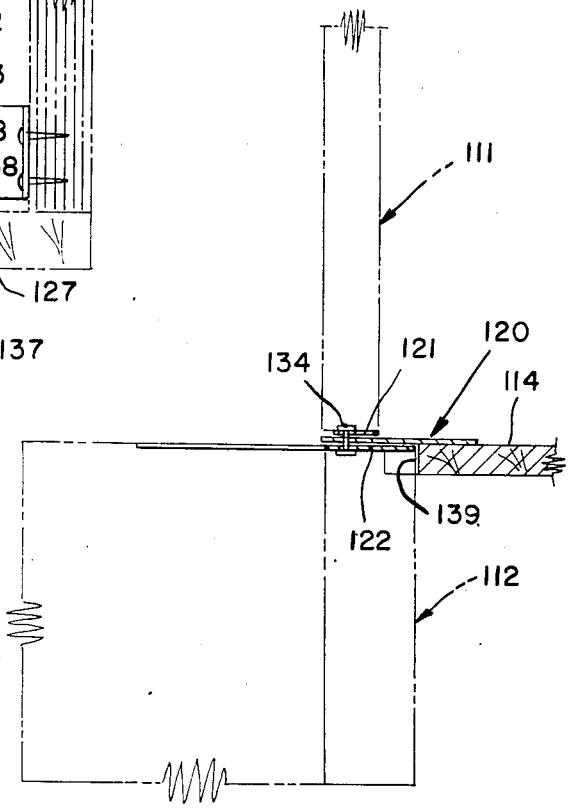
FIG. 16 is a cross section taken along line 16—16 of FIG. 15. The upper door is shown in the closed position while the lower door is shown in the open position.

Installation of the intermediate base member is similar to the installation of the hinges described in FIG. 1. The preferred installation is to cut out the intermediate shelf 114 along line 139 but the entire shelf may be set along alternate edge line 146 as indicated in FIG. 15.

Figure 17:
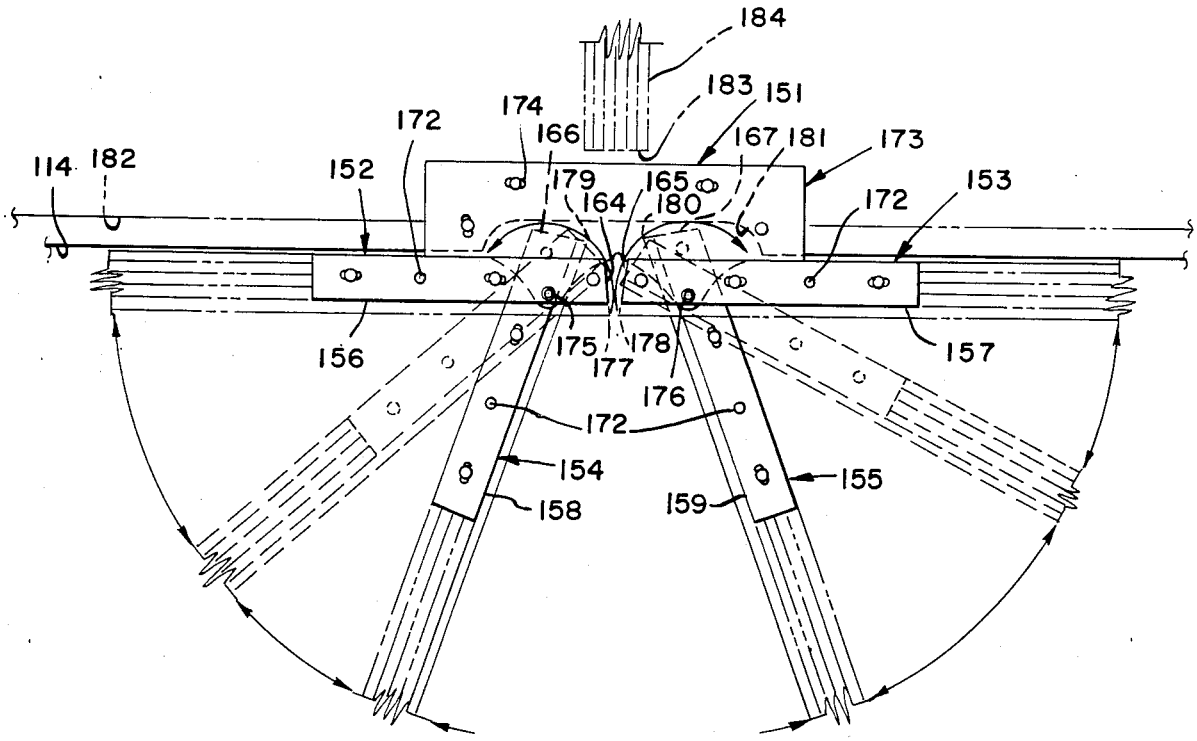
FIG. 17 is a top plan view of still another form of the invention taken generally along line 17—17 in FIG. 13. The upper doors are shown in the closed position while the lower doors are shown in the open position. The doors are shown in phantom line for purposes of clarity. The hinges and doors shown in dotted lines show an intermediate position of either the upper or lower doors.

Still another modified hinge member 151 is illustrated in FIG. 17. This hinge member is located in the vicinty of FIG. 17—17 as shown in FIG. 13. The hinge consists of pairs of upper and lower intermediate elongated door plate members 152–155 having front edges 156–159, rear edges 160–163, pivot end edges 164–167 and distal end edges 168–171. Fastener openings 172 are formed therethrough and adapted for connection to the respective upper and lower door bottom and top faces.

An intermediate base plate member 173 is formed with openings 174 adapted for receipt of screw fasteners therethrough and for engagement with the intermediate base member.

A pair of intermediate pivot means such as pins or rivots 175 and 176 are connected to the intermediate elongated door plate members 152–155 at a location adjacent the front edges and the pivot end edges and are connected to the intermediate base plate member at a location overlying and underlying the pair of upper and lower doors.

The pivot means is further located with respect to the intermediate door plates and the intermediate base plate at points sufficient distance from the adjoining planar sides of the upper and lower doors so that the arc scribed by the front pivot corners 177–180 of each of the upper and lower pairs of doors in edge to edge relationship do not intersect one another.

The installation of the hinge member 151 is similar to the installation of the hinge member previously described and illustrated in FIG. 12. In the preferred form of the invention, a cut out portion is formed along line 181 to a sufficient depth so that the pivot ends 166 and 167 of the lower doors may pivot freely. The hinge member may also be mounted on the intermediate base member relative to the front edge 182 so that no cutting of the intermediate base member is required. Preferably, the end 183 of any divider 184 is cut off to permit the installation of the base plate member 173.

I claim:

1. In combination, a door, a frame and a pair of concealed hinges for said door mavable from a closed to an open position said door having a substantially planar front face and a rear face, generally parallel planar top and bottom edge faces and a substantially planar end face intersecting said planar front face and forming a front pivot corner and mounted in said frame defining an opening having generally parallel planar top and bottom bases and said frame including a generally perpendicular jamb frame member having a substantially planar front face and presenting a substantially planar side face generally parallel to and closely spaced from said planar door end face and said pivot corner when said door is in said closed position; each of said concealed hinges comprising:

a. an elongated door plate member having a front edge, a rear edge, a pivot end edge and a distal end edge and formed with fastener openings therethrough and connected to said respective door bottom and top edge faces adjacent said door front pivot corner;

b. a base member formed with fastener openings connected to said respective top and bottom frame bases;

c. pivot means connected to said door plate member at a location adjacent said front edge and said pivot end edge and connected to said base plate member at a location overlying and underlying said door respectively; and d. said pivot means is located with respect to said elongated door plate member and said base plate member adjacent said door front face and adjacent said door end face at a point sufficient distance from saids planar side face of said perpendicular jamb frame member and from said front face of said door so that the arc scribed by said front pivot corner of said door adjacent said perpendicular jamb frame member when said door is pivoted about said pivot means from said closed to open positions does not intersect said planar end face of said perpendicular jamb frame member, and said planar front face of said door when in said closed position is substantially parallel or in the same plane as said front face of said jamb frame member.

e. at least one of said fastener openings in said door plate members is elongated in its longitudinal direction to permit adjustment of the relative attachment of said door in a longitudinal direction; and f. at least one of said fastener openings in said base plate member is elongated in a direction at right angles to said door when said door is in its closed postion so as to permit adjustment of the location of said base plate member relative to said frame opening.

2. A combination as described in claim 1 wherein:

a. said base plate members each are formed with a front edge in which a portion of said front edge is parallel to a portion of the rear edge of said door plate member when said door is closed.

3. A cokmbination as described in claim 1 wherein said top and bottom edge faces of said door are formed with a routed portion having a depth substantially the same as the thickness of said door plate leaving a portion of said front face and said door extending above and below said door plate member wherein;

a. said door plate memeber is dimensioned for receipt within said routed portion of said respective top and bottom edge faces of said door.

4. A combination as described in claim 1 having a first mirror mounted on said front face of said door and a second mirror mounted on said front face of said jamb frame member wherein:

a. said front edge of said door plate is generally parallel to and positioned rearwardly of said rear face of said first mirror; and b. said second mirror on said front face of said jamb frame member is in the same plane as said first mirror on said front face of said door when said door is in said closed position.

5. In combination, a pair of doors, a frame and a pair of concealed hinges for said pair of doors mounted in edge to edge relationship and mounted for rotation in opposite directions from closed to open positions; said doors having front substantially planar faces mounted in the same plane and rear faces, generally planar top and bottom edge faces, and generally planar end faces closely spaced from and parallel to one another when said doors are in said closed positions and said planar door end faces intersect said planar door front faces forming front pivot corners closely adjacent one another and said doors are mounted in said frame defining an opening having generally planar top and bottom bases, said top and bottom bases having planar front faces and said hinges each comprising:

a. a pair of elongated door plate members having a front edge, a rear edge, a pivot end edge and a distal end edge and formed with fastener openings therethrough and connected to said respective door bottom and top edge faces adjacent said respective front poviot corners of said doors;

b. a base plate member formed with fastener openings connected to said respective top and bottom frame bases;

c. pairs of top and bottom pivot means connected to said door plate members at a location adjacent said front edges and said pivot end edges and connected to said base plate members at a location overlying and underlying said doors respectively; and d. said pivot mens are located with respect to said door plate and said base plates at points sufficient distance from said adjoining planar end faces of said doors so that the arc scribed by said front pivot corner of each of said doors in edge to edge relationship do not intersect one another when said doors are pivoted about said pivot means from said closed to open position and said planar front faces of said doors when in said closed position are substantially parallel to or in the same plane as said front faces of said jamb frame members.

6. In combination, a pair of concealed hinges and a folding side table movable from a folded vertical to a horizontal position and said table having top and generally planar bottom faces, generally planar right and left side edge faces and a generally planar end face intersecting said planar top face and forming a front pivot corner mounted on a table frame defining an opening having generally parallel right and left sides and a beam member having a planar front face presenting a bottom planar face generally parallel to and closely adjacent said side table end face when said table is in said folded vertical position and each of said concealed hinges comprising:

a. an elongated side table plate member having a front edge, a rear edge, a pivot end edge and a distal end edge and formed with fastener openings therethrough and adapted for connection to said respective right and left side edged faces of said side table adjacent said front pivot corner of said table;

b. a base plate member formed with fastener openings adapted for engagement with said respective right and left sides of said table frame;

c. pivot means connected to said side table plate member at a location adjacent said front edge and said pivot end edge and connected to said base plate member at a location adjacent said right and left sides of said side table; and d. said pivot means is located with respect to said base plate member and said side table plate member at a point sufficient distance from said underface of said beam member and from said front face of said side table so that the arc scribed by said front pivot corner of said side table does not intersect said bottom face of said beam member when said table is pivoted about said pivot means from said folded vertical position to said horizontal position and said planar top face of said side table is substantially parallel to or in the same plane as said front face of said beam member when said table is in said folded vertical position.

7. In combination, a pair of upper and lower doors, a frame, and a set of concealed top and bottom hinges and an intermediate concealed hinge for said pair of upper and lower doors movable from a closed to an open position and each having a substantially planar front face mounted in substantially the same plane and a rear face, generally parallel top and bottom planar edge faces and a planar end face intersecting said planar front face and forming a front pivot corner and mounted in a frame defining an opening having generally parallel top and bottom bases divided by an intermediate base member and said frame including a generally perpendicular jamb frame member having a substantially planar front face and presenting a planar side face generally parallel and closely adjacent to said planar door end face when said doors are in said closed position, comprising;

a. said concealed top and bottom hinges each having:

(1) an elongated door plate member having a front edge, a rear edge, a pivot end edge and a distal end edge and formed with fastener openings therethrough and connected to said respective door bottom and top faces adjacent said door front pivot corner;

(2) a base plate member formed with fastener openings connected to said respective top and bottom frame bases;

(3) pivot means connected to said upper and lower door plate members at a location adjacent said front edge and said pivot end edge and connected to said base plate member at a location respectively overlying or underlying said upper and lower door;

(4) said pivot means is located with respect to said respective door plate and said base plate member at a point sufficient distance from said side face of said perpendicular jamb frame member and from said front face of said door so that the arc scribed by said front pivot corner of said doors adjacent said perpendicular jamb frame member when said doors are pivoted about said pivot means from said closed to open positions does not intersect said planar end face of said perpendicular jamb frame member and said planar front faces of said doors when in said closed position are substantially parallel to or in the same plane as said front face of said jamb frame member;

b. said concealed intermediate hinge having:

(1) a pair of intermediate elongated door plate members each having a front edge, a rear edge, a pivot edge and distal end edge and formed with fastener openings therethrough and connected to said respective door bottom and top faces of said upper and lower doors adjacent said front pivot corners of said doors;

(2) an intermediate base plate member formed with fastener openings for engagement with said intermediate base member;

(3) intermediate pivot means connected to said intermediate elongated door plate members at a location adjacent said front edge and said pivot end edge and connected to said intermediate base plate member at a location overlying said lower door and underlying said upper door; and (4) said pivot means is located with respect to said respective intermediate door plates and intermediate base plate member at a point sufficient distance from said side face of said perpendicular jamb frame member and from said front faces of said upper and lower doors so that the arcs scribed by said front pivot corners of said doors adjacent said perpendicular jamb frame member do not intersect said end face of said perpendicular jamb frame member when said doors are pivoted about said pivot means from said closed to open positions.

8. In combination, a frame, and a set of concealed upper and lower hinges, and a concealed intermediate hinge and pair of upper and lower doors mounted in edge to edge relationship and mounted for rotation in opposition directions from closed to open positions, said pairs of upper and lower doors having substantially planar front faces in substantially the same plane and rear faces, generally planar top and bottom edge faces, and generally planar end faces closely spaced from and parallel to one another when said doors are in said closed positions and said planar door end faces intersect said planar door front faces forming front pivot corners closely adjacent one another, one said doors are mounted in said frame defining an opening having generally planar top and bottom bases, said top and bottom bases have substantially planar front faces, and said frame is divided by an intermediate base member, comprising:

a. said upper and lower concealed hinges each comprise:

(1) a pair of elongated door plate members having a front edge, a rear edge, a pivot end edge and a distal end edge and formed with fastener openings therethrough and connected to said respective upper and lower door bottom and top edge faces and adjacent said respective front pivot corners of said doors;

(2) a base plate member formed with fastener openings connected to said respective top and bottom frame bases;

(3) pairs of top and bottom pivot means connected to said door plate members at a location adjacent said front edges and said pivot end edges and connected to said base plate members at a location respectively overlying and underlying said pairs of upper and lower doors;

(4) said pivot means are located with respect to said door plate members and said base plate member at points sufficient distance from said adjoining planar sides of said door so that the arc scribed by said front pivot corner of each of said upper and lower pairs of doors in edge to edge relationship do not intersect one another; when said doors are pivoted about said pivot means from said closed to open positions and said planar front faces of said doors when in said closed positions are substantially in the same plane to one another and in the same plane as said front faces of said top and bottom bases;

b. said concealed intermediate hinge having:

(1) pairs of upper and lower intemediate elongated door plate members each having a front edge, a rear edge, a pivot end edge and a distal end edge and formed with fastener openings therethrough connected to said respective upper and lower door bottom and top faces;

(2) an intermediate base plate member formed with fastener openings connected to said intermediate base member;

(3) a pair of intermediate pivot means connected to said intermediate elongated door plate members at a location adjacent said front edges and said pivot end edges and connected to said intermediate base plate member at a location overlying and underlying respectively said pair of upper and lower doors; and (4) said pivot means are located with respect to said intermediate door plates and said intermediate base plate at points sufficient distance from said adjoining planar sides of said upper and lower doors so that the arc scribed by said front pivot corner of each of said upper and lower pairs of doors in edge to edge relationship do not intersect one another when said doors are pivoted about said pivot means from said closed to open positions.

* * * * *

UNITED STATES PATENT AND TRADEMARK OFFICE

CERTIFICATE OF CORRECTION

PATENT NO. : 4,704,766

DATED : November 10, 1987

INVENTOR(S) : Henry C. Almestad

It is certified that error appears in the above-identified patent and that said Letters Patent is hereby corrected as shown below:

Column 3, line 58, change the word "joint" to ---point---
Column 4, line 23, after the words "12 leaving" insert ---a---
Column 5, line 66, change the word "meaber" to ---member---
Column 6, line 14, change the word "ae" to --- are---

Column 7, line 51, change the word "mavable" to ---movable---
Column 8, line 3, after the words "a base" insert ---plate---
Column 8, line 41, change the word "cokmbination" to --- combination---

Column 9, line 13, change the word "poviot" to --- pivot---
Column 9, line 22, change the word "mens" to --- means---

Column 11, line 25, change the word "one" to ---and---

Signed and Sealed this

Nineteenth Day of April, 1988

*Attest:*

*Attesting Officer*

DONALD J. QUIGG

*Commissioner of Patents and Trademarks*